United States Patent [19]

Van Onstein et al.

[11] Patent Number: 4,944,400

[45] Date of Patent: Jul. 31, 1990

[54] SELF-SUPPORTING STORAGE, SHIPPING AND DISPLAY ASSEMBLY

[75] Inventors: Elco T. J. M. Van Onstein; Antonius C. G. Leebeek, both of Brussels, Belgium

[73] Assignee: The Procter & Gamble Company, Cincinnati, Ohio

[21] Appl. No.: 234,852

[22] Filed: Aug. 22, 1988

[30] Foreign Application Priority Data

Aug. 28, 1987 [GB] United Kingdom ..... 8720422

[51] Int. Cl.[5] ..... B65D 21/00; A47G 19/00

[52] U.S. Cl. ..... 206/509; 206/511; 220/23.6; 220/23.83

[58] Field of Search ..... 206/509, 511; 220/23.2, 220/23.4, 23.6, 23.83

[56] References Cited

U.S. PATENT DOCUMENTS

| | | | |
|---|---|---|---|
| 2,970,715 | 2/1961 | Kappel et al. | 206/509 X |
| 3,131,829 | 5/1964 | Masser | 220/23.4 X |
| 3,297,196 | 1/1967 | Cornelius | 220/23.4 X |
| 3,333,727 | 8/1967 | Belcher et al. | 206/509 |
| 3,404,805 | 10/1968 | Stockman et al. | 220/23.6 X |
| 4,328,902 | 5/1982 | North | 220/23.4 |

*Primary Examiner*—Allen M. Ostrager
*Attorney, Agent, or Firm*—R. C. Witte; J. V. Gorman; M. E. Hilton

[57] ABSTRACT

An assembly created of multiple layers of semi-rigid trays. The size of the surface area of the assembly can be increased by use of side interlocking elements on each tray. These side interlocking elements do not consist of extra parts which require fairly dexterous manipulation, sometimes in the center of a large surface area. Additionally, these side interlocking elements are rotation symmetrical and self-centering, all of which enhances the potential for automated handling. The tray layers are separated by containers which are held by formations in the upper and lower surfaces of each tray. The formations in upper surface of the lower tray layer and the lower surface of the upper tray layer cooperate to hold the containers such that the containers touch each other along their sides and are maintained in a substantially vertical position, which is particularly suited for containers prone to bulging and creeping. Shrinkwrap may be applied to the outside of this tray and container assembly upon completion to the desired surface area and height to add additional strength and stability.

11 Claims, 4 Drawing Sheets

SELF-SUPPORTING STORAGE, SHIPPING AND DISPLAY ASSEMBLY

FIELD OF INVENTION

This invention relates to a storage, shipping and display assembly for layered products and, more particularly, to assemblies in which trays are used intermediate adjacent layers to support and hold the products in position.

BACKGROUND OF THE INVENTION

Present packing, shipping, storage and displaying techniques have made it desirable to design the packaging material necessary to protect individual containers at each one of the above stages in such a way that even containers which are prone to bulging or creeping, e.g. polyethylene bottles, are protected while also providing maximum flexibility in the use of the individual constituents of the packing material during the various stages of the container's life.

Generally, the manufacturer of the containers differs from the user of the containers so that the empty, possibly fragile, containers have to be transported from one place to another. Subsequently, the empty containers have to be transported along the filling line and, after sealing, palletized in such a way that the total pallet load is suitable for storage, shipping and sales point display.

This situation makes it desirable that at least one of the constituents of the packing material is of such a nature that it can accommodate the containers at the different stages of their useful life; from the limited surface area of a filling line to the larger surface area of a pallet. In addition, it is highly desirable that the required handling operations be automated. Furthermore, it is highly desirable that the materials of the individual packing constituents be reduced as much as possible, thus reducing costs. Measures to accomplish this reduction include incorporating the inherent strength of each container into the total assembly strength and utilizing a design which leaves a minimum of scrap. Lastly, it is highly desirable that said packing constituents, when not in use, occupy as little space as possible.

European patent No. 0,099,827 describes trays which are inserted between superposed layers of bottles whereby the upper surface of the tray accommodates the bottoms of bottles in recesses and the lower surface of the tray accommodates the upper parts of the bottles in a subjacent level in recesses. The finished stack of superposed filled trays is then held together with a shrinkwrap. However, the recesses for the bottle bottoms and the bottle tops are positioned in such a way that the bottles never touch each other along their side edges. Additionally, the text refers only to glass bottles, which are not subject to bulging or creeping.

PCT patent application number U.S. No. 81/01459 describes a bottle carrier, the lower surface of which is equipped with bottle gripper supports to grasp the neck of bottles and suspend them. The upper surface of the bottle carrier is equipped with an area of bottle seats centered relative to each gripper for receiving the bottoms of upright bottles held in a similar carrier thereabove. No reference is made however to the building of a storage, shipping and display assembly, nor to the building of trays with variable surface areas.

European patent application No. 0,162,162 describes a bottle crate of reduced height whereby the crate is capable of resting on bottles in a subjacent crate through the use of formations depending downwardly from the body of the crate and defining sockets for receiving upper portions of bottles. No reference is made however to forming a storage, shipping and display assembly of variable surface area.

Belgian patent No. 693,216 describes a tray which is equipped with recesses on its upper surface to accommodate one or several bottoms of bottles and with recesses in its under surface to accommodate the top part of bottles already inserted in a subjacent tray. The location of the recesses in the upper or lower surface of the trays can be such that the bottles are kept in upright or slanted position. Individual trays can be attached to each other sidewise by using extra pins. No reference is made, however, to the skillful use of the inherent strength of bottles subject to bulging and creeping to increase the supporting capability of the assembly while reducing the amount of protecting packing material.

SUMMARY OF THE INVENTION

An object of the invention is to provide a storage, transportation and display assembly which is adaptable to the physical limitations imposed by these various stages.

It is also an object of the invention that the handling of this assembly throughout its various stages can be accomplished with automated means.

It is a further object of this invention that said assembly be stable enough that it can even accommodate multiple layers of containers prone to bulging and creeping.

Additionally, it is an object of this invention that said assembly be reusable and require as little material beyond the containers themselves as possible thereby reducing costs, weight, scrap and storage space.

Other objects will become apparent hereinafter.

In accordance with one aspect of the present invention there is provided a self-supporting storage, shipping and display assembly which includes a horizontally layered stack of semi-rigid compound trays filled with containers. The upper surface of each compound tray has upward surface holding means for accommodating the bottoms of the containers. In addition, these upward surface holding means are positioned such that the side edges of adjacent containers are in contact with each other without exerting any pressure on each other. Also, the bottom surface of each compound tray has downward surface holding means for accommodating the tops of containers on a subjacent compound tray. These downward surface holding means are positioned to hold the containers of the subjacent compound tray in a substantially vertical position. Furthermore, each compound tray is composed of a plurality of coplaner individual trays equipped with cooperating interlocking elements along contiguous vertical side edges to interlock each individual tray with an adjacent individual tray to form compound trays.

BRIEF DESCRIPTION OF THE DRAWINGS

While the specification concludes with the claims which particularly point out and distinctly claim the subject matter forming the present invention, it is believed that the invention will be better understood from the following description of the preferred embodiment taken in conjunction with the accompanying drawings in which:

DESCRIPTION OF THE PREFERRED EMBODIMENTS

Figure 1:
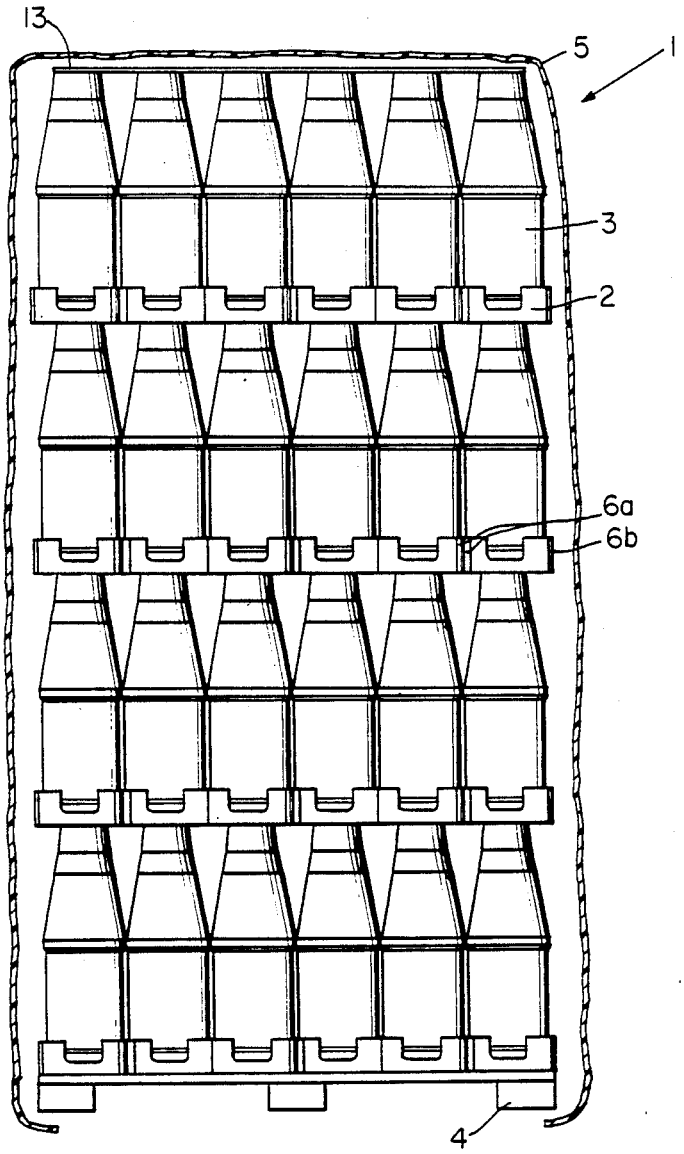
FIG. 1 is a front elevational view of a preferred embodiment of the self-supporting storage, shipping and display assembly according to the invention.

The present invention provides for a self-supporting storage, shipping and display assembly 1 consisting of layers of a variable number of semi-rigid trays 2 filled with containers 3.

Each individual tray 2 is dimensioned in such a way that it can be used to transport empty containers 3 along a filling line to the filling station, and subsequently receive the filled and sealed containers 3 back in their original location. As is well-known in the art, the dimensions suitable for a filling line are far too small for the standard sized pallets. For this reason, the individual trays 2 have been equipped with integral interlocking elements 6 which are so positioned that individual trays 2, when interlocked along their side edges, can form larger tray surfaces compatible with standard pallet surface areas. In order to ensure the self-supporting characteristic of the assembly 1, said interlocking elements 6 are so positioned that during the formation of the assembly the sidewalls of containers 3 accommodated along the edge of each individual tray 2, are substantially in contact with adjacent containers 3 located along the edge of a contiguous individual tray 2 when the trays are interlocked, without the containers 3, however, exerting any substantial pressure against each other, i.e. any resulting pressure would not deform the sidewalls of the containers 3.

Figure 2:
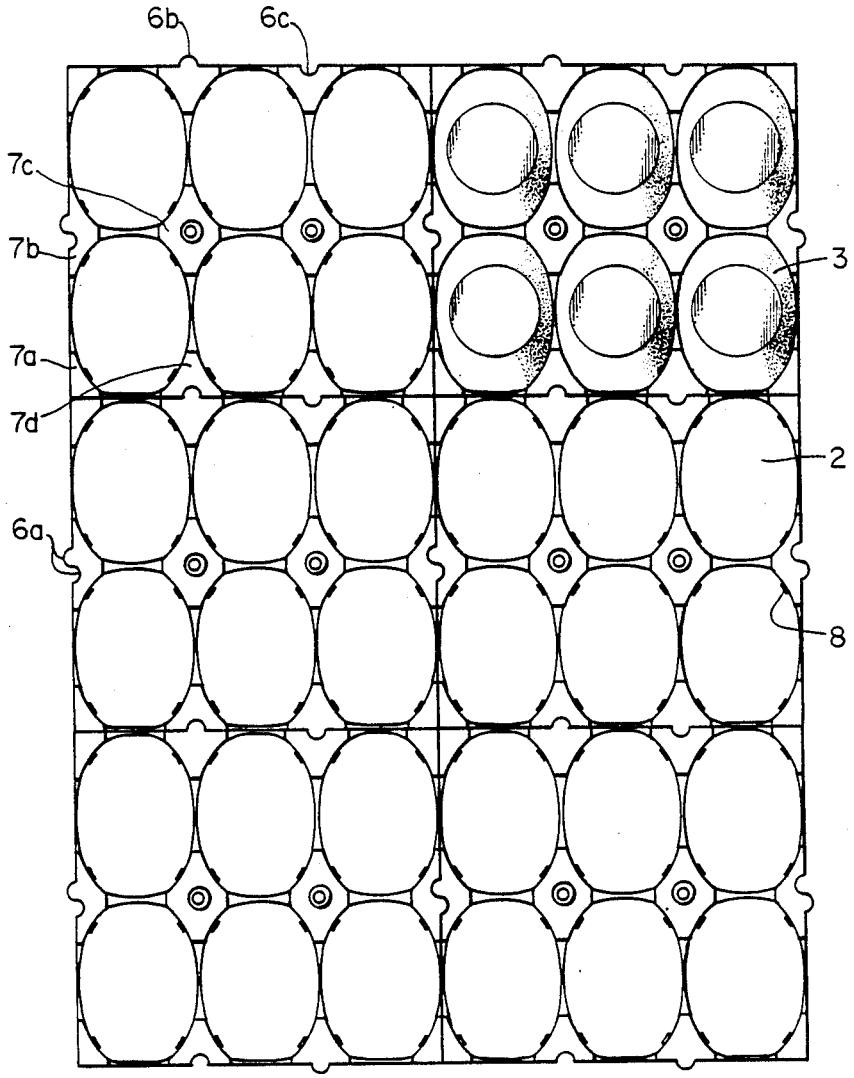
FIG. 2 is a plan view of 6 individual trays which are interlocked, one tray being filled with six individual containers.
Figure 3:
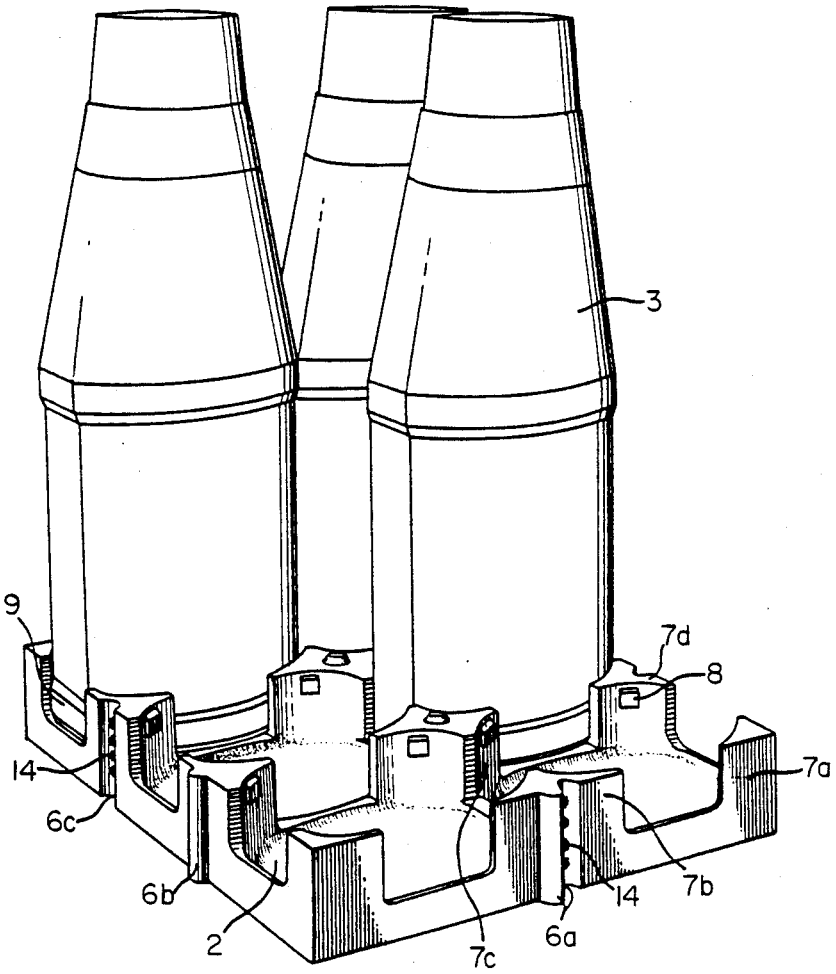
FIG. 3 is a perspective view of the upward surface of a partially filled individual tray.
Figure 4:
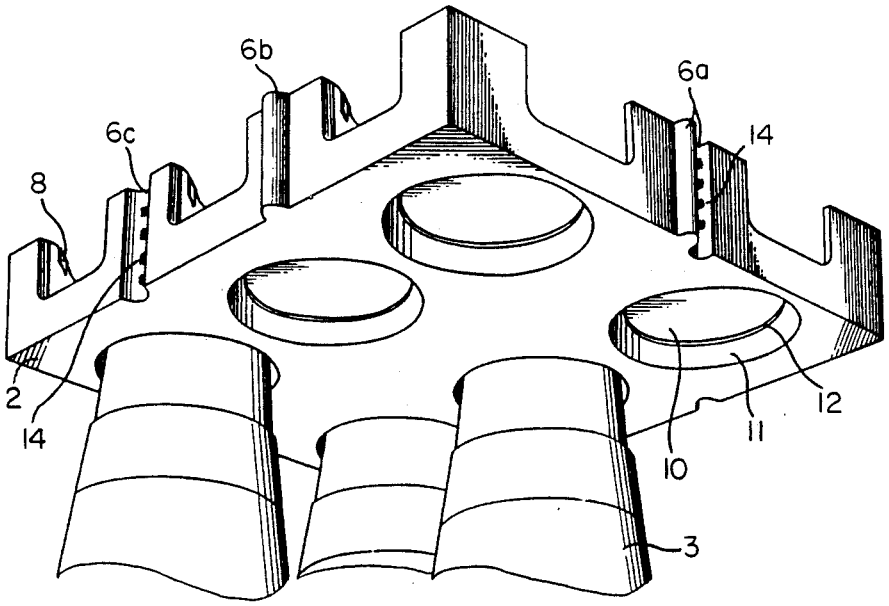
FIG. 4 is a perspective view of the downward surface of an individual tray already resting on three containers.

The trays 2 are further designed to enhance the possible automation of the handling of the trays 2. The interlocking elements 6 of each tray 2 are so designed that they are self-centering, which means their shape permits interlocking even though there is slight initial misalignment during the interlocking operation. FIGS. 2, 3 and 4 show that if there is a slight initial misalignment of the interlocking elements 6, the interlocking elements 6 will slide against each other's curved surfaces until the misalignment is corrected and the individual trays 2 interlock. Although the interlocking elements 6 of the preferred embodiment are only self-centering in the horizontal plane they could be designed self-centering in the vertical direction as well. In addition, these side mounted interlocking elements 6 require no additional pieces other than the trays 2 themselves. Therefore, there is no need to store and handle extra pieces, nor to gain access to the center of compound trays to perform the rather dexterous act of placing a pin in a hole. Also, due to the configuration of the interlocking elements 6, as seen in FIG. 3, the interlocking elements 6 interengage by relative movement in the horizontal plane and without the necessity of vertical movement of the trays relative to each other. All these features increase the ability to automate the interlocking operation. Furthermore, the individual trays 2 are rotation symmetrical, meaning the individual trays 2 will interlock even if one tray 2 is rotated about its central vertical axis. The preferred embodiment, in FIG. 2, exhibits interlocking elements 6 which are rotation symmetrical with respect to sides having the same dimensions. In other words, the interlocking elements 6 of a side of a tray 2 will cooperate with the interlocking elements 6 of any other same dimensional side of any other identical tray 2. Each side of a tray 2, therefore, must have the identical placement and shape of interlocking elements 6 as any other same dimensional side of that tray 2. It is understood that a square tray could be made rotation symmetrical with respect to every side. This feature means there is no problem with line orientation which further enhances the possible automation of the handling of the trays 2 along the entire operation.

In addition, the upper surface of each individual tray 2 is equipped with upward surface holding means 7 which are dimensioned so as to exactly accommodate and hold firmly in place the bottom part of the containers 3 to be assembled. Likewise, the downward surface of each individual tray 2 is equipped with downward surface holding means 10 which are dimensioned so as to exactly accommodate the top part of the containers 3 already assembled in a subjacent tray. These holding means in the downward surface 10 of each tray 2 are so positioned that, when the top part of the containers 3 already sitting in a subjacent tray are introduced in these downward surface holding means 10, the containers are in substantially vertical position. Furthermore, the location of the upward 7 and downward 10 surface holding means are such that the individual containers 3, when sitting in said holding means, are in contact with one another along their side edges without exerting any substantial pressure on each other. This contact along the side edges of the individual containers 3, combined with the substantially vertical position, enable the containers 3, even if they are of a type subject to bulging or creeping, like polyethylene bottles, to become self-supporting. This self-supporting ability remains true even if the containers 3 are of such a size that, after filling, they become quite heavy and consequently exert considerable pressure on the containers 3 of the subjacent layer. This configuration also enables them to better resist the horizontal and vertical acceleration forces to which they are subjected during transportation.

To illustrate the importance of substantially vertical positioning it has been established that slanting of less than 2° for a storage duration of two months of filled polyethylene bottles within a temperature range of 4° to 32° C. is acceptable. If, however, high density polyethylene two liter containers filled with liquid are allowed to slant 5°, their vertical stacking strength will decrease by approximately 60%, resulting in pallet collapse if stacked to the normal maximum height.

The importance of individual container 3 immobilization aided by the contact along the side walls of the individual containers 3 is exemplified by the fact that each side wall of a fragile container can deform due to horizontal acceleration, resulting in a small horizontal displacement of the top relative to the bottom. When several container layers comprise the assembly 1, the sum of all these displacements can result in a total horizontal displacement sufficient to generate a torque that would topple the containers 3.

Also, in order to even better stabilize the self-supporting assembly during shipping and to protect it against dust up to the display stage, a shrinkwrap 5 is applied once the desired volume of the total assembly 1 has been reached. Before the shrinkwrap is applied either a stabilizing sheet 13 with a flat upper surface, or trays 2 with the upward holding means remaining empty can be placed on the top layer of containers. The number of layers of filled trays depends, upon the strength of the individual containers 3, the weight of the filled containers, the expected storage duration, and other parameters well known in the art.

The self-supporting characteristic of the assembly 1, obtained by the stabilizing action of the individual trays 2 holding the containers 3 in a generally vertical position with side-wise support of the individual containers 3 to each other, preventing bulging or creeping, combined with the additional immobilizing action of the shrinkwrap 5 reduces the material needed. Also, since this assembly including the recessed channel, prevents rubbing of the containers and their labels against each other during transportation there is no need for the generally used cardboard separations between containers to prevent damage to the container 3 and label surfaces. This is not only a substantial cost saving due to material savings and easier handling, but also gives much better visibility of the display at the sales point. Furthermore, the individual trays 2 are reusable and therefore it is important that they are easily stackable when empty and their reduced height saves storage space.

The self-supporting storage, shipping and display assembly 1 as illustrated in FIG. 1 consists of four layers of composite or compound trays filled with containers 3, topped by a stabilizing sheet 13, grouped on a pallet 4 and surrounded by shrinkwrap 5, which shrinkwrap has not yet been subjected to shrinkage.

Referring to FIG. 2, six individual trays 2 are interlocked to build a compound tray of larger surface area. Additionally, the individual tray in the upper right corner of the compound tray is filled with six individual containers 3.

Illustrated in FIG. 3, is an individual tray 2 with rotation symmetrical interlocking elements *6a, 6b* and *6c* represented along the visible side edges, corresponding rotation symmetrical interlocking elements being also provided on the two remaining side edges. After the trays 2 are filled but before they are interlocked, strips of a low strength glue 14 are applied on interlocking elements *6a* and *6c*, as well as on the corresponding rotation symmetrical interlocking elements on the two remaining side edges. The containers 3 are accommodated in the upward surface holding means composed of four elements *7a, 7b, 7c* and *7d* which are dimensioned to exactly hold the bottom of the containers 3. Each element *7a, 7b, 7c* and *7d* of the upward surface holding means is equipped with a notch 8 which snaps into place over the rim 9 of the container 3 when the container 3 is introduced into upward surface holding means of the semi-rigid tray 2, thereby holding said container 3 firmly in place.

Referring to the perspective view of FIG. 4 one can see the downward surface holding means 10, dimensioned to exactly accommodate the top part of the containers 3 in the downward surface of an individual tray 2. Said downward surface holding means 10, are built as recesses, the rim 11 of which is slightly slanted to form a conical recess, thereby allowing the top part of containers 3 to easily slide into the downward surface holding means 10 when the stack is built, thereby ensuring perfect centering of the containers 3. Once the top parts of the containers 3 are centered, they protrude into a ridge 12 which holds them firmly in place, creating substantially vertical positioning.

In order to build the self-supporting storage, shipping and display assembly 1 according to the invention for its first use, the container maker fills individual trays 2 with empty containers 3 and assembles them, using interlocking elements 6, to build the desired surface of the pallet which is to be loaded. Relatively low strength glue 14 can be applied on the interlocking elements, if desired. This glue 14 should be strong enough to resist the horizontal and vertical acceleration forces during transportation, and weak enough to allow separation of the trays 2 without damage to the trays 2 themselves. Additional layers are built in the same way and superposed until the desired stack height is obtained. Depending on the type of containers 3, a stabilizing sheet 13 or trays 2 are placed on the top layer of filled trays and the assembly is surrounded by shrinkwrap 5. The shrinkwrapped assembly 1 is then forwarded to the user of the empty containers 3 and, when the filling and closing operation is to start, the shrinkwrap 5 is removed and the individual trays 2 are detached from the stack and fed to the filling line where the individual containers 3 may be removed from the individual trays 2, filled and closed, and thereafter again inserted in the upward surface holding means 7 of the individual trays 2. The filling line can also be so designed that the individual containers 3 may remain in the individual trays 2 for filling and closing. The individual trays 2 holding filled containers 3 are subsequently assembled and built into the self-supporting storage, shipping and display assembly 1 according to the invention in the same way as this is done at the manufacturer of the empty containers. The assembly of filled containers is now ready for storage, shipping and again storage until displayed for sale. At the sales point the shrinkwrap 5 is torn away and the customers can remove the individual containers 3 according to their needs, the individual trays 2 being easily removable once a layer of containers is taken away. Due to the stability given by the trays 2 combined with the contact between the containers 3 along their side edges, the stack remains perfectly stable even when the shrinkwrap 5 is broken away. Smaller stacks can also be obtained by removing a number of layers of containers or by separating columns of trays; for example, by splitting an assembly built for a standard pallet surface into two assemblies. The fact that the trays 2 are rotation symmetrical and that both the downward surface holding means 10 and the interlocking elements 6 are self-centering greatly enhances the possibility of automation of the above described operations.

The tray 2 as represented in a preferred embodiment is made of expanded polyethylene foam which is known to be a highly shock-absorbent material. It is recognized, however, that semi-rigid trays 2 can also be made of other suitable semi-rigid materials like cardboard or thermoformed polystyrene, these trays being designed in such a way that they are provided with upward and downward surface holding means built in any manner well-known to the man of the art, and which hold the individual containers in such a way that the unique combination of substantially vertical positioning and side-contact of the individual containers without exerting substantial pressure on each other is obtained. Such trays would also fall within the scope of the self-supporting storage, shipping and display assembly according to the invention.

What we claim is:

1. A self-supporting storage shipping and display assembly including a horizontally layered stack of semi-rigid compound trays which are coextensive with each layer and filled with containers, wherein the upper surface of each compound tray is equipped with upward surface holding means for holding the bottoms of said containers such that adjacent containers are in contact with one another along their side edges without exerting any pressure on each other when placed therein, and wherein the bottom surface of each compound tray is equipped with downward surface holding means for holding the tops of containers on a subjacent compound tray, such that said containers are maintained in a substantially vertical position, wherein the improvement comprises: each compound tray being formed by a plurality of coplanar individual trays, said individual trays having cooperating interlocking elements along contiguous vertical side edges, said interlocking elements being self-centering and adapted for interengagement by relative movement only in the horizontal plane, said assembly further comprising means for preventing separation of said interlocking elements during transportation whereby to interlock each individual tray with an adjacent individual tray to form said compound tray.

2. The self-supporting storage, shipping and display assembly of claim 1, in which said interlocking elements and the upward and downward surface holding means are so positioned that containers along the contiguous edges of individual trays are substantially in contact.

3. The self-supporting storage, shipping and display assembly of claim 1 or 2 in which said interlocking elements are rotation symmetrical.

4. The self-supporting storage, shipping and display assembly of claim 1, in which said interlocking elements and the upward and downward surface holding means are so positioned that containers along the contiguous edges of individual trays are substantially in contact, and said interlocking elements are rotation symmetrical.

5. The self-supporting storage, shipping and display assembly of claim 1, 2 or 4, in which said means for preventing separation of said interlocking elements is provided by adhering said cooperating interlocking elements by glue being sufficiently strong to counteract normal transportation forces yet sufficiently weak to permit separation of said trays without damaging said trays themselves.

6. The self-supporting storage, shipping and display assembly of claim 3, in which said means for preventing separation of said interlocking elements is provided by adhering said cooperating interlocking elements by glue being sufficiently strong to counteract normal transportation forces yet sufficiently weak to permit separation of said trays without damaging said trays themselves.

7. The self-supporting storage, shipping and display assembly of claim 1, or 4, in which the upward and downward surface holding means are so positioned that sidewalls of adjacent containers are in non-deforming contact.

8. The self-supporting storage, shipping and display assembly of claim 3, in which the upward and downward surface holding means are so positioned that sidewalls of adjacent containers are in non-deforming contact.

9. The self-supporting storage, shipping and display assembly of claim 5, in which the upward and downward surface holding means are so positioned that sidewalls of adjacent containers are in non-deforming contact.

10. The self-supporting storage, shipping and display assembly of claim 6, in which the upward and downward surface holding means are so positioned that sidewalls of adjacent containers are in non-deforming contact.

11. The self-supporting storage, shipping and display assembly of claim 1, 2 or 4, in which the material from said individual trays are made or selected from the class consisting of cardboard, thermoformed polystyrene and expanded polystyrene foam.

* * * * *